United States Patent [19]

Gerrard

[11] 4,044,740

[45] Aug. 30, 1977

[54] BURNER ASSEMBLY FOR AN INLET MANIFOLD OF AN INTERNAL COMBUSTION ENGINE

[75] Inventor: Alan Joseph Gerrard, Blackburn, England

[73] Assignee: Lucas Industries Limited, Birmingham, England

[21] Appl. No.: 628,554

[22] Filed: Nov. 4, 1975

[30] Foreign Application Priority Data

Nov. 6, 1974 United Kingdom ..... 47951/74

[51] Int. Cl.[2] ..... F02M 31/00

[52] U.S. Cl. ..... 123/122 G; 123/179 H; 123/122 D; 432/222

[58] Field of Search ..... 123/122 G, 179 H, 142.5 R, 123/122 D; 432/222

[56] References Cited

U.S. PATENT DOCUMENTS

| | | | |
|---|---|---|---|
| 3,388,900 | 6/1968 | Taylor | 432/222 |
| 3,822,987 | 7/1974 | Zanst | 432/222 |
| 3,955,538 | 5/1976 | Noguchi | 123/122 G |

*Primary Examiner*—Ronald H. Lazarus
*Attorney, Agent, or Firm*—Holman & Stern

[57] ABSTRACT

A burner assembly for an inlet manifold of a diesel engine consists of a hollow body including inner and outer annular casings defining between them an air passage. The air passage is divided by radial walls into sets of first and second compartments. Each of the first set of compartments has an inlet thereto at one end of the body, and an aperture at the other end of the body provides communication between each compartment of the first set and a combustion zone defined within the inner annular casing. Each compartment of the second set has an aperture, said one end of the body providing communication between said compartment and the combustion zone. Additionally, each compartment of the second set has an outlet at the opposite end of the body. The outlets which are defined by a circular disc having segment shaped portions extending integrally therefrom also communicate directly with the combustion zone. A fuel/air atomizer is disposed at said one end of the body to discharge into the combustion zone.

4 Claims, 5 Drawing Figures

BURNER ASSEMBLY FOR AN INLET MANIFOLD OF AN INTERNAL COMBUSTION ENGINE

This invention relates to a burner assembly for heating air in an inlet manifold of an internal combustion engine and is more particularly, though not exclusively, concerned with a burner assembly which is commonly known as a manifold burner for mounting in the inlet manifold of a diesel engine. Such a manifold burner is an aid to starting in cold climates, and also assists in reducing exhaust smoke and other noxious emissions under light engine load conditions.

According to the present invention, there is provided a burner assembly for heating air in an inlet manifold of an internal combustion engine, said burner assembly comprising a hollow body adapted to be mounted in the inlet manifold, a fuel sprayer arranged to discharge fuel into a combustion zone within the hollow body, said body having a plurality of inlets at one end thereof and a plurality of outlets at an opposite end thereof, and baffle means within the body serving to prevent direct interconnection between the inlets and the outlets, the arrangement being such that air passing through the inlets is constrained to flow into the combustion zone before reaching the outlets, the outlets being arranged to communicate directly with the combustion zone.

Conveniently, the body comprises a first annular casing and a second annular casing spaced inwardly of the first annular casing so as to define an air passage between the casings, and the baffle means divides the air passage into a first series of compartments alternating with a second series of compartments, each compartment of the first series being connected with one of the inlets, and each compartment of the second series being connected with one of the outlets, and an aperture through the second annular casing serving to connect each compartment with the interior of the second annular casing, which interior defines the combustion zone.

Conveniently, the aperture associated with each compartment of the first series is disposed adjacent said opposite end of the body and the aperture associated with each compartment of the second series is disposed adjacent the said one end of the body.

Preferably, the outlets are defined in an end wall of the body which overlaps the first and second annular casings.

Most advantageously, the baffle means comprises a plurality of baffle plates which are spaced apart around the air passage, adjacent pairs of baffle plates being interconnected by an end plate at said one end of the body, and spaces between adjacent end plates defining said inlets.

An embodiment of the present invention will now be described, by way of example, with reference to the accompanying drawings, in which.

Figure 1:
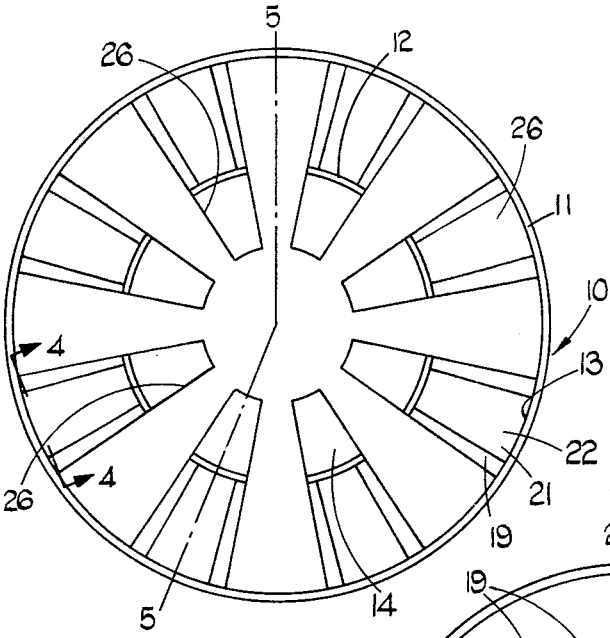
FIG. 1 is an end view of a burner assembly according to the present invention.
Figure 2:
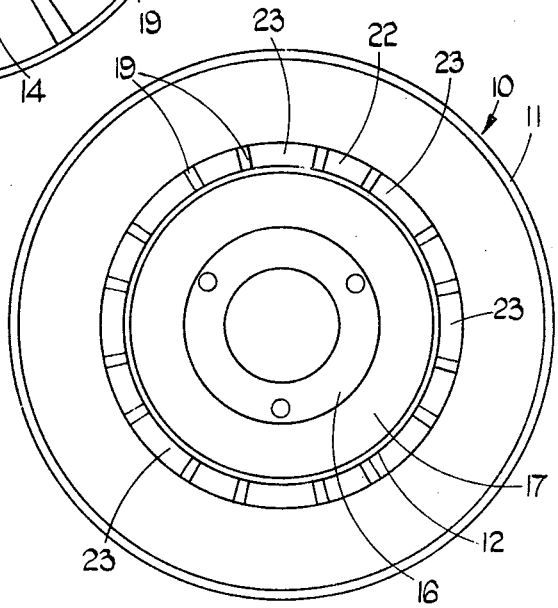
FIG. 2 is an opposite end view of the burner assembly of FIG. 1.
Figure 3:
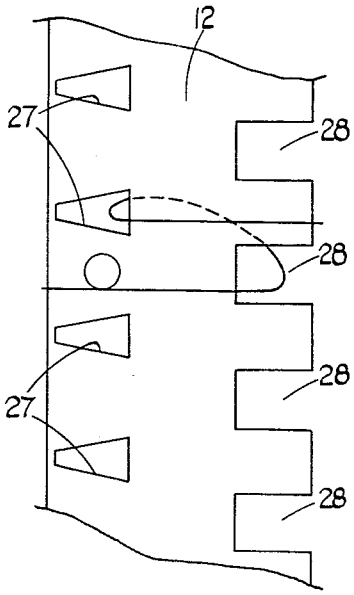
Figure 4:
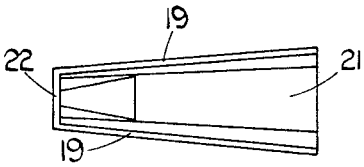
Figure 5:
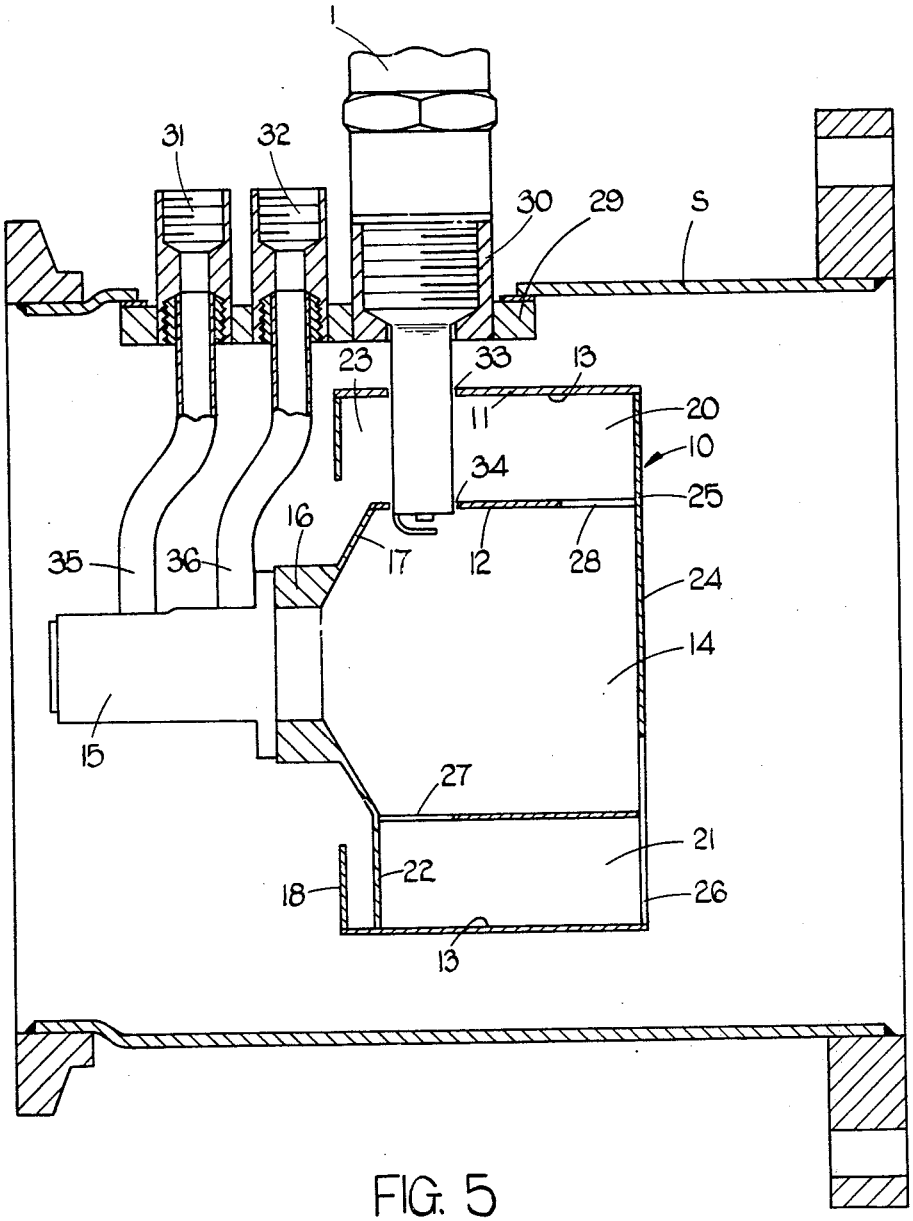

FIG. 3 is a developed view of part of an internal casing within the burner assembly of FIGS. 1 and 2, FIG. 4 is a section on the line 4—4 of FIG. 1, and FIG. 5 is a longitudinal sectional view of an inlet manifold of a diesel engine fitted with the burner assembly of FIGS. 1 to 4, the burner assembly being shown in longitudinal section on the line 5—5 of FIG. 1.

Referring to the drawings, the burner assembly comprises a hollow body 10 which includes a first annular casing 11 and a second annular casing 12 which is spaced inwardly of the first annular casing 11 so as to define an air passage 13 therebetween. The interior of the second annular casing 12 defines a combustion zone 14. The burner assembly also comprises a fuel atomiser 15 which is arranged to discharge into the combustion zone 14. The atomiser 15 is secured by bolts (not shown) to one end of a sleeve 16 which is provided at its other end with an outwardly extending, integral shell portion 17 which is of generally frusto-conical shape. The shell portion 17 is welded around its periphery to the second annular casing 12.

At the end of annular casing 11 adjacent shell portion 17, there is provided an inwardly directed annular plate 18 which is welded around its outer periphery to the first annular casing 11 so as to define an annular gap between its inner periphery and the shell portion 17. The interior of the air passage 13 is divided by means of radial walls 19 into a plurality of first compartments 20 alternating with a plurality of second compartments 21, the radial walls 19 extending from one end of the body to the other end. The radial walls 19 are arranged so that each radial wall 19 is connected with one adjacent radial wall 19 by means of an end plate 22 disposed at an end of the body 10 adjacent plate 18. In this manner, there are defined a plurality of inlets 23 to the body each inlet 23 opening into one of the first compartments 20. At the end of the body 10 remote from plate 18, there is provided an end wall defined by a circular disc 24 having a plurality of integral, substantially segment shaped portions 25, extending radially therefrom. The portions 25 are spaced apart around the disc 24 and are welded at their peripheries to the first annular casing 11. The portions 25 are so positioned that they close the first compartments 20 at the ends thereof remote from inlets 23. Spaces between the portions 25 lie opposite second compartments 21 and define outlets 26 from the body 10. As can be seen from FIGS. 1 and 5 the outlets 26 communicate directly with the combustion zone and also with the second compartments 21.

The second annular casing 12 is provided with a series of peripherally spaced, substantially wedge shaped apertures 27 therethrough which serve to provide direct communication between each second compartment 21 and the combustion zone 14. The apertures 27 are located adjacent the end of the body 10 in which the inlets 23 are provided. The second annular casing 12 is also provided with a series of peripherally spaced, generally rectangular apertures 28 therethrough. The apertues 28 serve to provide direct communication between the first compartments 20 and the combustion zone 14.

The burner assembly further includes a flanged sleeve S which is bolted to a flange of the inlet manifold when the burner assembly is fitted to a diesel engine. The flange sleeve S carries a support plate 29 which in turn supports an internally screw threaded sleeve 30 and a pair of internally screw threaded unions 31 and 32. The sleeve 30 accommodates an electrical igniter I which projects into the body 10 through apertures 33 and 34 provided in the respective first and second annular casings 11 and 12 so that the tip of the igniter I is exposed in combustion zone 14. The unions 31 and 32 are connected with the atomiser 15 by way of respective pipes 35 and 36 which also serve to support entirely the body 10 within sleeve S. The unions 31 and 32 are also connected respectively with sources of fuel and air (not shown).

In use, with the burner assembly installed in the inlet manifold of a diesel engine, fuel and air are passed into the atomiser 15 through respective pipes 35 and 36 and unions 31 and 32. An atomised spray of fuel and air is projected into the combustion zone 14 by the atomiser 15 and the mixture within the zone 14 is ignited by the igniter I. Air passing along the inlet manifold enters sleeve S and some of the air therein passes into the body 10 through the inlets 23. After passing into the inlets 23, the air passes along the compartment 20 to enter the combustion zone 14 via apertures 28 in the second annular casing 12. The circulation of air within combustion zone 14 is promoted by the air entering combustion zone 14 via apertures 28 and thence passing towards the end of the body 10 at which the sprayer 15 is provided. The hot gases resulting from combustion of the fuel pass through apertures 27 to enter second compartments 21. Thereafter, the hot gases within compartments 21 leave the body 10 by way of the portions of outlets 26 which communicate directly with the second compartments 21. Part of the combustion gases in the combustion zone 14 resulting from air entering from apertures 28 will also be ejected from the body 10 via portions of the outlets 26 which communicate directly with the combustion zone 14. The above described construction of burner assembly provides an extremely efficient heating of the air in the inlet manifold and the circulation of the air and hot gases within the body 10 is efficiently promoted by the combined action of the atomiser 15 and the design of the body 10.

It is found that a relatively pollution-free exhaust is obtained from a diesel engine fitted with a burner assembly as described above, when the burner assembly is in operation.

I claim:

1. An internal combustion engine having an air inlet manifold in combination with a burner assembly for heating air in said air inlet manifold, said burner assembly comprising (i) a hollow body mounted in said inlet manifold, said hollow body including a first annular casing and a second annular casing spaced inwardly of said first annular casing so as to define an air passage between said casings, (ii) a plurality of inlets at one end of said body, (iii) a plurality of outlets at an opposite end of said body, (iv) baffle means dividing said air passage into a first series of compartments alternating with a second series of compartments, each compartment of said first series being connected with one of said inlets, and each compartment of said second series being connected with one of said outlets, (v) an aperture through said annular casing serving to connect each said compartment with an interior of said second annular casing, which interior defines a combustion zone of said burner assembly, and (vi) a fuel sprayer arranged to discharge fuel into said combustion zone, the arrangement being such that air passing through said inlets is constrained to flow into said combustion zone before reaching said outlets, said outlets being arranged to communicate directly with said combustion zone.

2. The combination according to claim 1, wherein said aperture associated with each said compartment of said first series is disposed adjacent said opposite end of said body and said aperture associated with each said compartment of said second series is disposed adjacent said one end of said body.

3. The combination according to claim 1, wherein said outlets are defined in an end wall of said body which overlaps said first and second annular casings.

4. The combination according to claim 1, wherein said baffle means comprises a plurality of baffle plates which are spaced apart around said air passage, adjacent pairs of said baffle plates being interconnected by an end plate at said one end of said body, and spaces between said adjacent end plates defining said inlets.

* * * * *